US006224370B1

(12) United States Patent
Tomizawa et al.

(10) Patent No.: US 6,224,370 B1
(45) Date of Patent: May 1, 2001

(54) COMBUSTION APPARATUS

(75) Inventors: Takeshi Tomizawa, Ikoma; Tatsuo Fujita, Osaka; Akira Maenishi, Toyonaka; Jiro Suzuki, Nara; Katuyuki Ohara, Katano, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/109,947

(22) Filed: Jul. 6, 1998

(30) Foreign Application Priority Data

Jul. 4, 1997 (JP) ..... 9-180117

(51) Int. Cl.[7] ..... F23D 3/40

(52) U.S. Cl. ..... 431/326; 431/7; 165/166

(58) Field of Search ..... 431/326, 328, 431/329, 7, 170; 422/173, 177, 175, 174; 502/178; 60/723; 165/166, 167

(56) References Cited

U.S. PATENT DOCUMENTS

| | | | | |
|---|---|---|---|---|
| 4,926,645 | * | 5/1990 | Iwai et al. | 60/723 |
| 5,228,847 | * | 7/1993 | Lywood et al. | 431/7 |
| 5,258,164 | * | 11/1993 | Bloom et al. | 422/174 |
| 5,259,754 | * | 11/1993 | Dalla Betta et al. | 431/326 |
| 5,352,114 | * | 10/1994 | Numoto et al. | 431/328 |
| 5,375,999 | * | 12/1994 | Aizawa et al. | 431/328 |
| 5,393,499 | * | 2/1995 | Bagley et al. | 422/174 |
| 5,512,250 | * | 4/1996 | Betta et al. | 431/328 |
| 5,552,360 | * | 9/1996 | Farrauto et al. | 431/7 |
| 5,711,661 | * | 1/1998 | Kushch et al. | 431/329 |
| 5,797,737 | * | 8/1998 | Le Gal et al. | 431/7 |
| 5,901,700 | * | 5/1999 | Suzuki et al. | 431/7 |

FOREIGN PATENT DOCUMENTS

| | | |
|---|---|---|
| 196 01 957 A1 | 7/1996 | (DE) . |
| 0 716 263 A2 | 6/1996 | (EP) . |
| 0 798 512 A2 | 10/1997 | (EP) . |
| 60-207818 | 10/1985 | (JP) . |
| 3-241213 | 10/1991 | (JP) . |
| 07019418 | 1/1995 | (JP) . |
| 7-316888 | 12/1995 | (JP) . |

OTHER PUBLICATIONS

European Search Report, Application No. EP98112202 dated Oct. 5, 1999.

* cited by examiner

*Primary Examiner*—Ira S. Lazarus
*Assistant Examiner*—David Lee
(74) *Attorney, Agent, or Firm*—Ratner & Prestia

(57) ABSTRACT

A combustion apparatus has a fuel supply section; an air blowing section for supplying combustion air; a mixing section for mixing the fuel with the combustion air; a plurality of first catalyst bodies which are arranged substantially in parallel with each other to divide the downstream location in the flow direction of mixture into a plurality of flow paths; and a first heat receiving section configured by a plurality of heat receiving fins arranged in flow paths divided by said first catalyst bodies and a cooling path penetrating the heat receiving fins, the opposed heat receiving fin and first catalyst body being characterized in that the area of the heat receiving fin on the upstream side of said cooling path is smaller than the area of the first catalyst body on the upstream side of the cooling path.

27 Claims, 12 Drawing Sheets

COMBUSTION APPARATUS

BACKGROUND OF THE INVENTION

1. Field of the Invention

The present invention relates to a combustion apparatus for a heating apparatus used for a heater, hot water supply system, air conditioner, and the like.

2. Related Art of the Invention

In place of the conventional combustion apparatus forming flame, a catalytic combustion apparatus has been proposed in which the emission of nitrogen oxides is greatly reduced and the exhaust gas is made clean. However, if the catalytic combustion apparatus is operated with the same combustion intensity (combustion amount per combustion chamber volume) as that of the flame combustion apparatus, the catalyst body temperature reaches 1200° C. or higher, exceeding the heat resistance limit of catalyst, so that the service life is decreased remarkably.

As a means to solve this problem of combustion intensity, as shown, for example, in one embodiment of Japanese Patent Application No. 7-316888 shown in FIG. 16. a combustion system is available which is made up of a first catalytic combustion section 104 having a system for simultaneously carrying out combustion and heat exchange and a second catalytic combustion section 112 having a honeycomb catalyst body 114 provided on the downstream side of the first catalytic combustion section 104. The fuel mainly burns while performing heat exchange in the first catalytic combustion section 104, so that the temperature does not rise unlike the flame combustion, and naturally flame is not formed. The remaining lean fuel is catalytically burned in the second catalytic combustion section 112 on the downstream side. Here is utilized the advantage of catalytic combustion combustible even if the fuel is lean. The first catalytic combustion section 104, which uses the high heat transfer characteristics of combustion of a catalyst 107, is provided with the catalyst body 107 in the vicinity of a heat receiving fin 105, constituting a heat exchange type catalytic combustion section. The water in a cooling path 108 turns to warm water in the first catalytic combustion section 104 and an exhaust heat recovery section 106. Since the heat receiving fin 105 for heat exchange is directly covered by the catalyst body 107, the heat transfer rate of generated heat in the catalyst 107 to the heat receiving fin 105 is high. Therefore, this system is a compact and high-efficiency heat exchanger integrated combustor.

When combustion is started, it is necessary to heat the catalyst beforehand to the reaction temperature or higher. For this purpose, there is proposed a method in which flame is formed before the start of catalytic combustion or a method in which the first catalytic combustion section and second catalytic combustion section are preheated by an electric heater before the start of combustion.

The present invention was made to solve the following two problems with a conventional two-stage catalytic combustion apparatus of this type.

1. Stabilization of first-stage catalytic combustion and increase in endurance life In the two-stage catalytic combustion apparatus, the operation of cooling in the combustion section is essential because combustion takes place with the same air-fuel ratio as that of flame combustion and at a temperature lower than the heat resistance limit temperature. However, it is difficult to stably perform the inconsistent operation in which cooling is performed while heat is stably generated by a catalyst. Under certain conditions, if the heat generation is excessive in the first-stage catalyst, the first-stage catalyst temperature increases dramatically, so that the heat resistance limit temperature is exceeded. If cooling is excessive, the combustion reaction at the first stage decreases, so that high-concentration unburned gas slips to the downstream side. When the second-stage catalyst exists, the combustion therein becomes excessive, so that the second-stage catalyst exceeds the heat resistance limit temperature. To prevent these phenomena, it has conventionally been necessary to accurately control the air-fuel ratio and other conditions, and the stable combustion of the first-stage catalyst, which is the main combustion, has been demanded to make the combustor more excellent.

Generally, the reactivity of catalyst is sometimes decreased by the long-term use and the service conditions. To improve the practicality, it is important to prevent this phenomenon. For the catalyst for combustion, the use at a temperature below the heat resistance temperature is essential. The heat resistance temperature, differing depending on the type of catalyst and the like, is said to be approximately 900° C. for a precious metal catalyst normally used for combustion. Because this is characteristic of catalyst material, how to use catalyst is a point. From this viewpoint as well, it is found that it is an important problem to stabilize the first-stage catalytic combustion by properly setting the heating and cooling in the combustion section and to maintain the catalyst temperature at a proper value.

2. Improvement in thermal efficiency and improvement in energy saving

Thermal equipment is always required to have a high thermal efficiency. The most important point for meeting this requirement is that the heat dissipation loss is at a minimum, so that it is desired to reduce heat dissipation loss caused by the convection from the body surface. Conventionally, a method of covering the surface with an insulating material has been used. However, this method is contrary to the trend of downsizing of equipment. Also, because the catalytic combustor has a construction in which elements are packed in the combustion chamber, it is difficult in the catalytic combustion system to use a configuration such that a water passage is arranged around the combustion chamber, this configuration being often used in the flame combustion system.

Further, in the catalytic combustion, it is necessary to heat the catalyst beforehand to the activation temperature or higher in order to start combustion reaction, so that a preheating means such as an electric heater is often used. However, there arises a problem in that preheating takes much time because the heater itself has a heat capacity, and the rise time is longer than that of the flame combustion. The long rise time caused by the use of electric heater for preheating leads to an increase in electric power consumption, with the result of impaired energy saving.

SUMMARY OF THE INVENTION

The present invention was made in view of the above problems 1 and 2 with the conventional catalytic combustion apparatus, and the means of solving the problems are as follows:

1. For the purpose of stabilization of first-stage catalytic combustion and increase in endurance life, there is provided a combustion apparatus having a fuel supply section, an air blowing section for supplying combustion air, a mixing section for mixing fuel with the combustion air, a plurality of first catalyst bodies which are arranged substantially in parallel with each other to divide the downstream location in the flow direction of mixture into a plurality of flow paths, and a first heat receiving section configured by a plurality of heat receiving fins arranged in flow paths divided by the first catalyst bodies and a cooling path penetrating the heat receiving fins, and the opposed area of the heat receiving fin is smaller than the area of the first catalyst body at least in the upstream direction of the cooling path. Alternatively, the opposed heat receiving fin and first catalyst body are characterized in that the upstream end of the heat receiving fin is located on the inside of the upstream end of the first catalyst body at least on the upstream side of the cooling path. The upstream end of the heat receiving fin located at least on the upstream side of the cooling path is substantially at an equal distance from the cooling path. Also, the upstream end of the heat receiving fin is of a wave form, or the upstream end of the heat receiving fin has many small holes. Also, the upstream end of the first catalyst body protrudes from the upstream end of the heat receiving fin toward the upstream side in the flow direction of the mixture. Also, on the upstream side of the cooling path, the area of the heat receiving section increases gradually from the upstream side to the downstream side. Also, the heat receiving fin is thicker than the first catalyst body, or at least one surface of opposed surfaces of the first catalyst body or the heat receiving fin is formed with a plurality of protrusions. Also, at least one penetrating member is provided to penetrate both of the first catalyst bodies and the heat receiving fins.

Also, a mixing unit is configured by the fuel supply section, the air blowing section for supplying combustion air, and a mixing section for mixing fuel with the combustion air. Further, the first catalyst bodies and the first heat receiving section are arranged in a housing configured by double walls having a heat medium passage therebetween, and the cooling path and the heat medium passage in the housing communicate with each other. Also, the combustion apparatus further comprises a second catalyst body provided on the downstream side of the first catalyst body and a second heat receiving section provided on the downstream side of the second catalyst body. Also, a second catalyst unit is configured by the second catalyst body and an electric heater, which is provided adjacent to the second catalyst body, for heating the second catalyst body. Also, the second heat receiving section provided on the downstream side of the second catalyst body is arranged in a housing configured by double walls having a heat medium passage therebetween, and a cooling path of the second heat receiving section and the heat medium passage communicate with each other.

By this configuration, the heat generation on the surfaces of the first catalyst bodies and the cooling action in the first heat receiving section are balanced, so that combustion can be continued at a proper temperature below the heat resistance temperature of the first catalyst body. The point is to increase the ratio of heat transfer quantity to the heat receiving section when the heat generation quantity on the surfaces of the first catalyst bodies is large and to decrease the ratio of heat transfer quantity to the heat receiving section when the heat generation quantity is small. Thus, even when the combustion quantity is changed, the temperature change of catalyst body is small, so that the catalytic combustion can be stabilized under various conditions. More specifically, since the heat transfer at this portion is effected between the catalyst body surface and the fin in the heat receiving section, the mutual relationship between the two, for example, position or material acts delicately. The present invention makes this relationship proper. Also, by making the heat transfer proper, a proper temperature distribution of catalyst body is achieved, so that the long service life of catalyst body itself can be made possible. Therefore, since this stable state is maintained for a long period of time, the practicality as the equipment becomes very high.

Next,

2. For the purpose of improvement in thermal efficiency and improvement in energy saving, there is provided a combustion apparatus having a mixing unit configured by fuel and combustion air, a first catalyst unit configured by a first catalyst body, a first heat receiving section, and a first housing formed by double walls having a heat medium passage therebetween, a second catalyst unit configured by a second catalyst body and an electric heater for heating, and a heat recovery unit configured by a second heat receiving section and a second housing formed by double walls having a heat medium passage therebetween, and the mixing unit, the first catalyst unit, the second catalyst unit, and the heat recovery unit are joined in the named order, and the heat medium passage formed in the first housing of the first catalyst unit and the heat medium passage formed in the second housing of the heat recovery unit communicate with each other. At this time, the effective configuration is such that the first heat receiving section and the second heat receiving section are configured by many fins and a cooling path penetrating the fins, and the cooling path communicates with the heat medium passage consisting of double walls of the first and second housings.

Further, the combustion apparatus has a fuel supply section, an air blowing section for supplying combustion air, a mixing section for mixing fuel with the combustion air, a first catalyst body provided on the downstream side of the mixing section, a first heat receiving section adjacent to the first catalyst body, a second catalyst body provided on the downstream side of the first catalyst body, and a second heat receiving section provided on the downstream of the second catalyst body, and a housing covering the whole of all elements has a double-wall construction, and the combustion air which has passed between the double walls is supplied to the mixing section.

Further, the combustion apparatus has a fuel supply section, an air blowing section for supplying combustion air, a mixing section for mixing fuel with the combustion air, a first catalyst body provided on the downstream side of the mixing section, a first heat receiving section adjacent to the first catalyst body, a second catalyst body provided on the downstream side of the first catalyst body, and a second heat receiving section provided on the downstream of the second catalyst body, and the second catalyst body has an air-permeable carrier and a catalyst layer formed on the surface of the carrier, and the carrier is formed mainly of a conductive heat-generating material. By forming the carrier of a material mainly containing silicon carbide, a more effective combustion apparatus can be configured.

By this configuration, the heat generated in the combustion section is used effectively, and at the same time the surface temperature of the equipment body is decreased to reduce the heat dissipation loss, so that the thermal efficiency of the whole equipment can be increased. Because the catalytic combustor has a configuration such that many elements are packed in a combustion chamber (so called in the flame combustor), it was difficult to provide a configuration such that a housing is surrounded by a water passage.

In the present invention, however, such a configuration is made possible by unitization. Also, the housing is of a double construction and combustion air is allowed to pass therebetween to preheat air, and the heat transferred to the air can be used for combustion, so that the heat loss can be reduced. At the same time, by cooling the housing of equipment, the housing temperature is decreased, and the heat dissipation from the surface can be prevented.

Also, since the heat capacity of the heated body during preheating can be decreased, a shortened rise time, which is difficult to realize in catalytic combustion, can be achieved, so that the power consumption in preheating is reduced and thereby energy saving is made possible. Also, the operability as the equipment is improved. Naturally, the combustion apparatus in accordance with the present invention can burn a variety of fuels from various gas fuels to various liquid fuels.

Thus, the present invention achieves the following effects.

1. Since a stable high-temperature portion of catalyst can be formed in a proper temperature range lower than the heat resistance temperature of catalyst, the temperature change of the catalyst body is small under various conditions, so that the stabilization of catalytic combustion can be achieved.

2. Since the temperature distribution of catalyst body can be set properly under various conditions, the above state can be maintained for a long period of service time, so that the deterioration in catalyst can be inhibited. Therefore, a combustion apparatus having high practicality can be provided.

3. The surface temperature of the equipment itself is decreased, and thereby the heat dissipation loss is reduced, so that the efficiency of heat utilization can further be increased.

4. Since the rise time is shortened, the electric power for preheating the catalyst can be saved, so that energy saving can be achieved.

5. A wide variety of fuels ranging from gas fuels to liquid fuels can be used, and a combustion apparatus having high operability can be provided.

PREFERRED EMBODIMENTS

Embodiments of the present invention will be described below with reference to the accompanying drawings.

Figure 1:
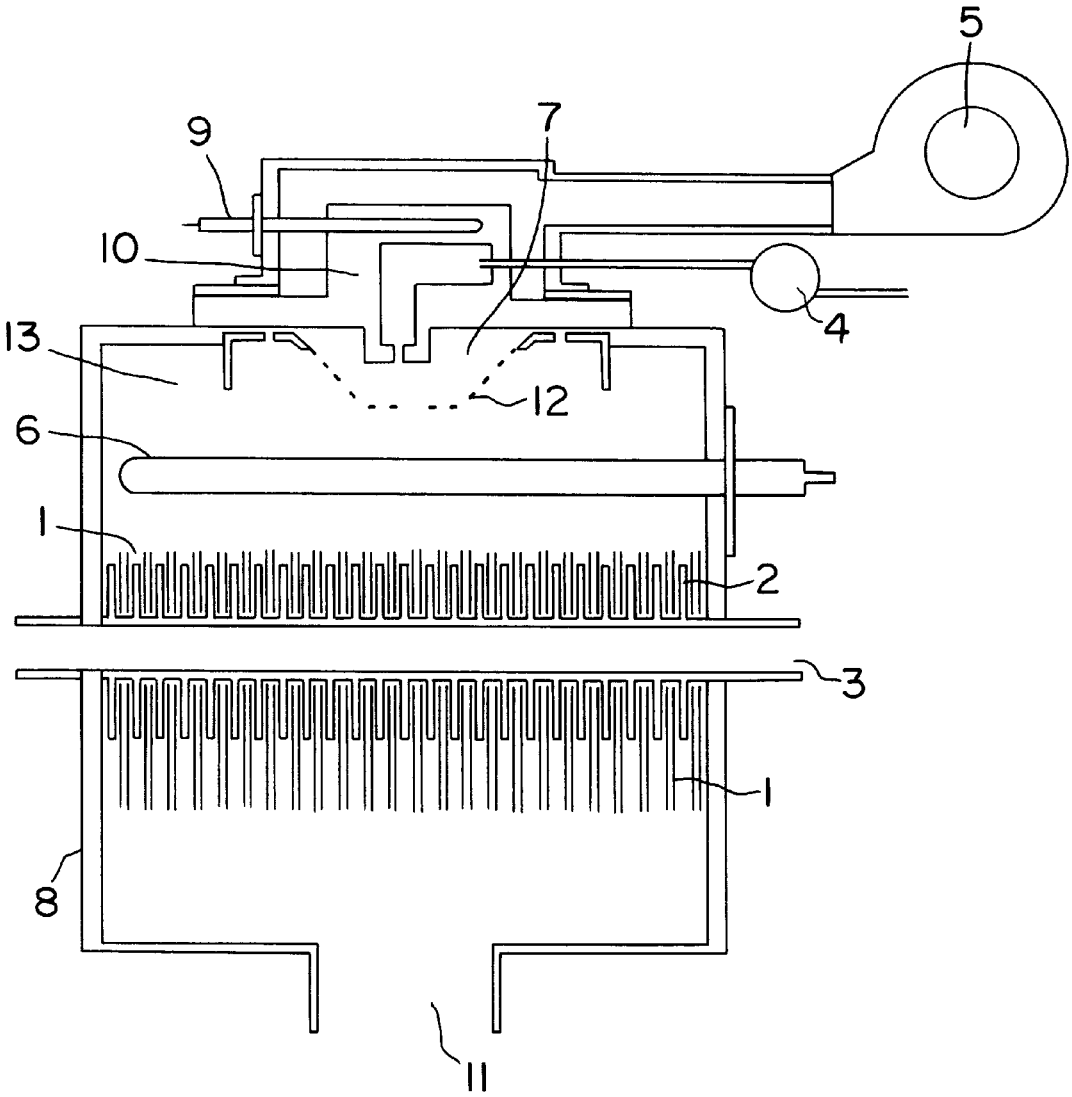
FIG. 1 is a sectional view showing one embodiment of a combustion apparatus in accordance with the present invention.

One embodiment of the present invention will be explained with reference to FIG. 1. FIG. 1 is a sectional view of a principal portion of one embodiment of a combustion apparatus in accordance with the present invention. In this figure, reference numeral 1 denotes a first catalyst body, which is configured by forming a catalyst layer on a plate-shaped heat-resistant metallic carrier. The catalyst layer is configured by distributing and carrying precious metal on an inorganic layer using alumina powder as a principal component. Many plate-shaped catalyst bodies 1 are arranged substantially in parallel to divide a flow path into plural numbers, and heat receiving fins 2 are disposed therebetween. Many heat receiving fins 2 are formed by joining to the surface of a cooling path 3 for allowing a heat medium (here, prepared mainly by water) to flow. The heat generated on the catalyst body surface via this heat receiving fin 2 is transferred to the heat medium efficiently. In this embodiment, the configuration is such that one heat receiving fin 2 is disposed every two catalyst bodies 1. Thus, the whole construction constitutes an integral-type combustion heat exchanger.

The recovered heat is supplied to a use side (not shown) such as a heating apparatus via the heat medium in the cooling path 3. Reference numeral 4 denotes a fuel supply section for combustion, and 5 denotes an air blowing section for supplying combustion air. In this embodiment, since a liquid fuel (gasoline) is used as a fuel, a vaporization section 10 incorporating a heater 9 (here, configured by an electric heater) is provided to vaporize the fuel in this section. Naturally, when a gas fuel is used, the heater 9 and the vaporization section 10 can be removed. Reference numeral 7 denotes a mixing section for mixing the fuel with air. The mixture formed here is sent to a combustion chamber 13 through a mixture blowing section 12 having many through holes. Reference numeral 6 denotes an electric heater for preheating and activating the catalyst bodies 1. When a catalytic oxidation reaction is started, a means for preheating the catalyst to the activation temperature is needed. In this embodiment, the electric heater 6 is used as this means. Needless to say, it is possible that the mixture blowing section 12 is used as a burner port, and an ignitor is provided in the vicinity of the burner port, by which preheating is performed by flame. Reference numeral 11 denotes an exhaust port, and 8 denotes a housing.

Next, the operation method of the embodiment configured as described above will be explained. First, simultaneously with the operation start, the heater 9 and the electric heater 6 are energized. By this operation, the temperatures of the vaporization section 10 and the catalyst bodies 1 are started to rise. When the temperatures of the two elements reach fixed values, fuel and air are supplied from the fuel supply section 4 and the air blowing section 5, respectively. The configuration is such that the electric heater 6 stops energizing at a proper time, but the heater 9 is energized appropriately based on the signal from a temperature detector (not shown) provided in the vaporization section 10 so that the temperature of the vaporization section 10 is proper. The fuel is vaporized in the vaporization section 10, and then mixed with air in the mixing section 7 to form a mixture, and flows into the combustion chamber 13 through the mixture blowing section 12. Immediately after that, the mixture passes through the catalyst bodies 1, and since the catalyst body 1 has reached the activation temperature, catalytic combustion is started on the surface of the catalyst body 1. When the combustion becomes vigorous and sufficient heat is generated, the combustion heat is transferred to the heat medium in the cooling path 3 via the heat receiving fin 2, by which the combustion heat is used for heating and the like. At this time, in relation to the heat use side, a pump or the like is operated at a proper time to circulate the heat medium. The catalyst temperature during the steady-state combustion is kept in the temperature range of about 350 to 900° C., and flameless combustion, in which flame is not formed, continues on the catalyst surface. The catalytic combustion has high reactivity even at low temperatures, and has a lower temperature than the flame combustion. Therefore, clean combustion, in which the exhaust gas contains a very small amount of harmful substances such as nitrogen oxides and carbon monoxide, is continued.

Figure 2:
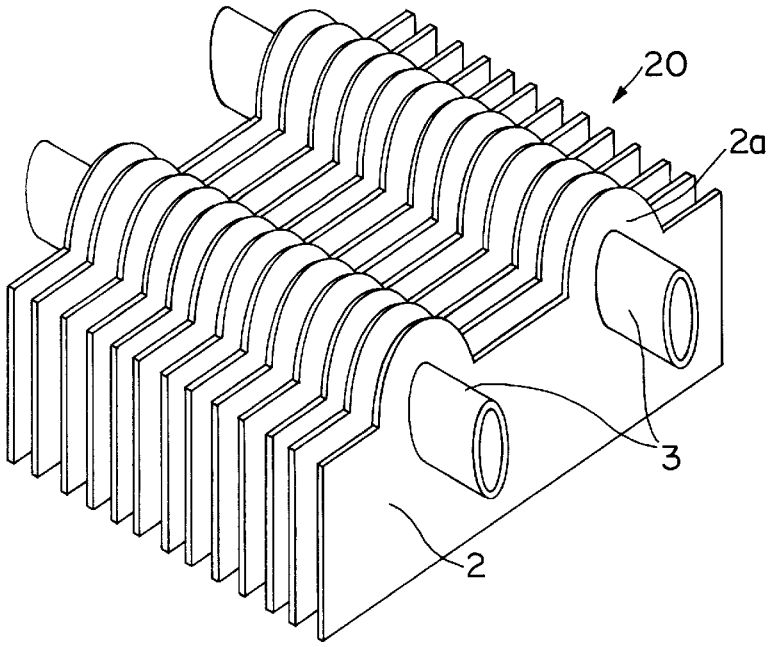
FIG. 2 is a detail view of heat receiving fins shown in FIG. 1 in accordance with the present invention.

FIG. 2 is a detail view showing a relationship between a catalyst body 1 and a heat receiving fin 2 of one embodiment shown in FIG. 1. The upside is the upstream side in the direction of mixture flow. In this configuration, two cooling paths 3, which are joined to the heat receiving fins 2 and pass through them, are disposed. Also, both of the heat receiving fins 2 and the cooling paths 3 are made of a heat-resistant stainless steel material. One or three or more cooling paths 3 may be provided in consideration of combustion quantity, heat transfer quantity, and the like. A heat receiving section 20 is formed by many heat receiving fins 2 and two cooling paths 3. The heat receiving fin 2 is shaped so as to have a portion 2*a* protruding to the upstream side around the cooling path 3. At this time, the protruding portion 2*a* is formed into a circular shape so that the upstream end thereof is at a substantially equal distance from the surface of the cooling path 3. That is to say, the relationship of concentric circle holds.

Figure 3:
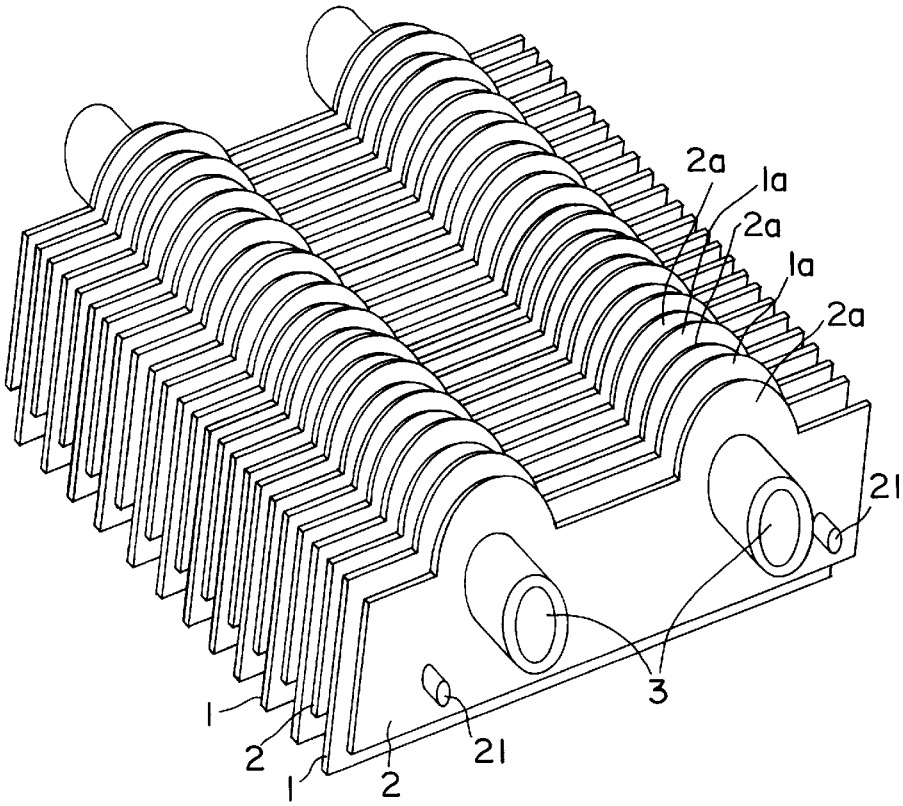
FIG. 3 is a detail view of catalyst bodies and heat receiving fins shown in FIG. 1 in accordance with the present invention.

FIG. 3 is a detail view showing a state in which the heat receiving section 20 shown in FIG. 2 and the catalyst bodies 1 are assembled. The catalyst body 1 has a shape substantially similar to the shape of the heat receiving fin 2 on both upstream and downstream sides. As a result, the catalyst body 1 also has a shape protruding to the upstream side. Reference numeral 1*a* denotes a protruding portion of the catalyst body 1. Further, in the upstream direction of the cooling path 3, the area of the heat receiving fin 2 is smaller than the area of the catalyst body 1. Also, in the downstream direction, the area of the heat receiving fin 2 is smaller than the area of the catalyst body 1.

This construction is suitable to properly maintain the heat generation on the surface of the catalyst body 1 and the cooling action by the heat receiving fin 2 and thereby to stabilize the catalytic combustion. The heat transfer from the surface of the catalyst body 1 to the heat receiving fin 2 is carried out mainly by radiation, but the heat transfer is very fast because the two elements are located at a small distance. Therefore, the heat transfer quantity is large at an opposed portion, and the heat transfer quantity is small at a portion where the two elements are not opposed to each other. Thereupon, at the former portion, the catalyst temperature decreases and the combustion reaction is not liable to proceed. At the latter portion, the catalyst temperature increases and the combustion reaction takes place more vigorously. To continue stable combustion, it is important that the catalyst body 1 has a proper high-temperature portion. Without this portion, the continuation of combustion sometimes becomes difficult only by a small change of combustion condition such as the air-fuel ratio. That is to say, by making the opposed area of the heat receiving fin 2 smaller than the area of the catalyst body 1 in the upstream direction of the cooling path 3, there can be formed a portion where the catalyst body 1 is not opposed to the heat receiving fin 2. Naturally, at this portion combustion can be caused at high temperatures, so that the combustion can be stabilized. Also, by making the shape of the upstream end of the heat receiving fin 2 at a substantially equal distance from the surface of the cooling path 3, the heat transfer quantity of fin can be equalized, by which the temperature of the heat receiving fin 2 can be kept uniform. The uniformity of temperature on the heat receiving side can make the temperature of the catalyst body 1 uniform, so that the combustion is naturally stabilized.

Reference numeral 21 denotes a penetrating member which penetrates the catalyst bodies 1 and the heat receiving fins 2 to make the positional relationship therebetween constant. By providing this penetrating member 21, the positional relationship between the catalyst body 1 and the heat receiving fin 2 is always kept constant, so that the above-mentioned effect can be maintained for a long period of time.

Figure 4:
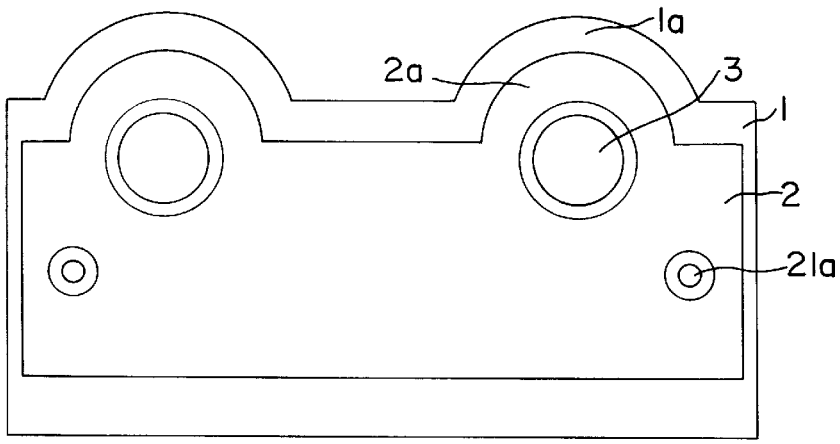
FIG. 4 is a detail view showing a relationship between a catalyst body and a heat receiving fin shown in FIG. 1 in accordance with the present invention.

FIG. 4 shows in more detail the relationship between the catalyst body 1 and the heat receiving fin 2 in FIG. 3. The penetrating member is shown as 21*a*. In the upstream direction (upside) of the cooling path 3, the shape of the catalyst body 1 is made similar to the shape of the heat receiving fin 2, and the area of the catalyst body 1 is made larger. At a portion protruding from the heat receiving fin 2, the catalyst body 1 has a high temperature, so that the combustion is stabilized. Here, the two elements have a similar shape on the downstream side. By the positional relationship between the catalyst body 1 and the heat receiving fin 2, the combustion reaction heat generated on the surface of the catalyst body 1 is transferred to the heat receiving fin 2 side while properly keeping the heat transfer surface at every portion, so that an excessive temperature rise especially at a part at the upstream end of the catalyst body 1 is restrained. Therefore, the nonuniformity of temperature at every portion of the catalyst is less, and the temperature distribution along the downstream side can be kept properly.

Figure 5:
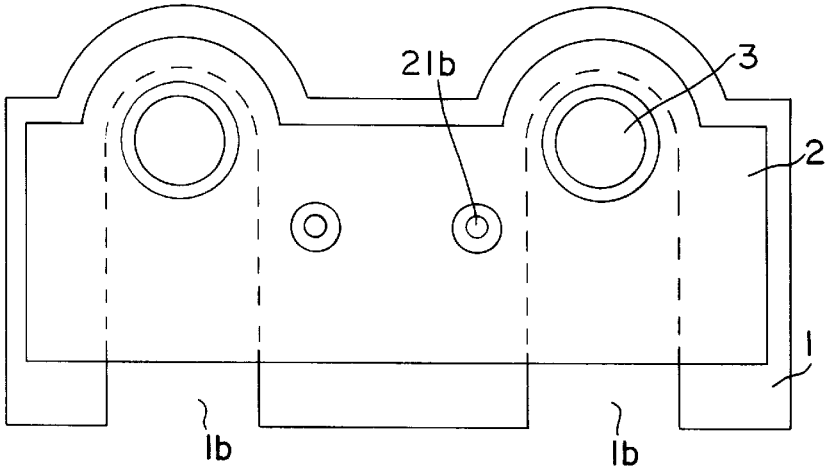
FIG. 5 is a detail view of another embodiment showing a relationship between a catalyst body and a heat receiving fin shown in FIG. 1 in accordance with the present invention.

FIG. 5 shows an embodiment in which the shape of the catalyst body 1 is changed. In this embodiment, comb teeth shaped notch portions 1*b* are provided in the catalyst body 1 on the downstream side at the positions of the cooling paths 3. By adopting this shape, the assembly can be made by inserting the catalyst body 1 between the heat receiving fins 2 from the upstream side, so that this construction is practical, and at the same time the above-mentioned effect can be achieved as well. Reference numeral 21*b* denotes the penetrating member.

Figure 6:
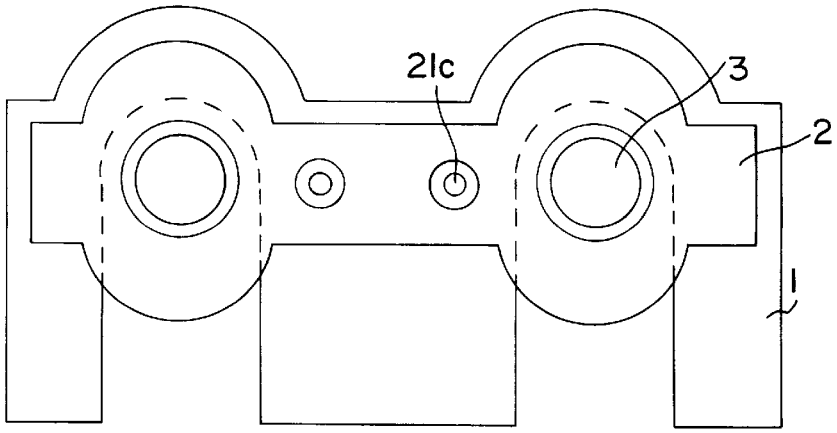
FIG. 6 is a detail view of still another embodiment showing a relationship between a catalyst body and a heat receiving fin shown in FIG. 1 in accordance with the present invention.

FIG. 6 shows an improved embodiment of FIG. 5, in which the shape of the heat receiving fin 2 is made equal on both the upstream and downstream sides. With this shape, further uniformity of the temperature of the heat receiving fin can be achieved. However, because the catalytic combustion is most active at the upstream end of the catalyst body 1, the shape on the downstream side does not contribute so much to the stabilization of combustion. Therefore, it is advantageous that other features such as easy configuration and uniform temperature are made to have priority over the shape on the downstream side.

Figure 7:
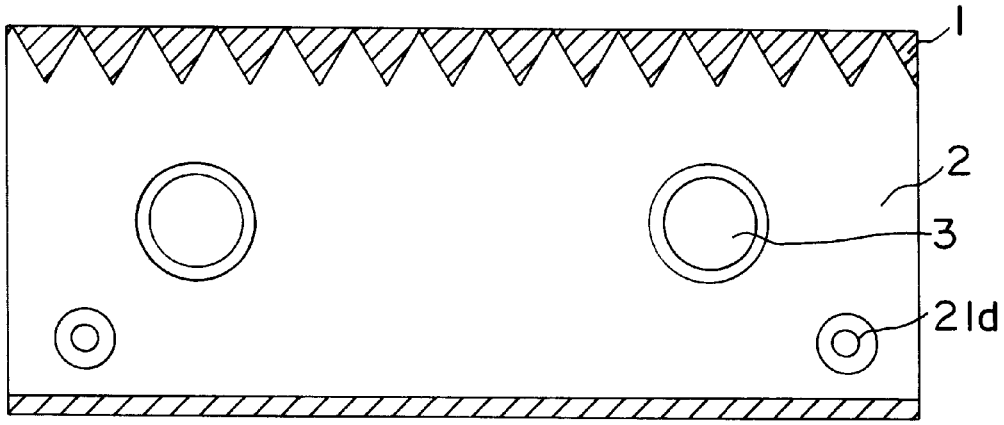
FIG. 7 is a detail view of still another embodiment showing a relationship between a catalyst body and a heat receiving fin shown in FIG. 1 in accordance with the present invention.

FIG. 7 shows another embodiment showing the relationship between the catalyst body 1 and the heat receiving fin 2. The upstream side of the heat receiving fin 2 has a wave-form shape. Reference numeral 21*d* denotes the penetrating member, and the other portions are the same as those in the above embodiment. By this configuration, the opposed area of the heat receiving fin 2 is made smaller than the area of the catalyst body 1 in the upstream direction of the cooling path 3. Also, on the upstream side of the cooling path 3, the area of the heat-receiving fin is increased gradually from the upstream side toward the downstream side. Thereby, the catalyst body 1 can be prevented from being formed with a location where the temperature changes suddenly from a high temperature at a portion protruding from the heat receiving fin 2 to a low temperature at a portion opposed to the heat receiving fin 2. Although this sudden temperature change is somewhat relaxed by the heat conduction of the catalyst body 1 itself, it is further relaxed by this configuration. If a portion where sudden temperature difference occurs is provided in the catalyst body 1, deformation etc. due to thermal strain sometimes occur in long-term use. This configuration can prevent this deformation. Thereupon, the catalyst body 1 can have a high-temperature portion suitable for stable combustion.

Figure 8:
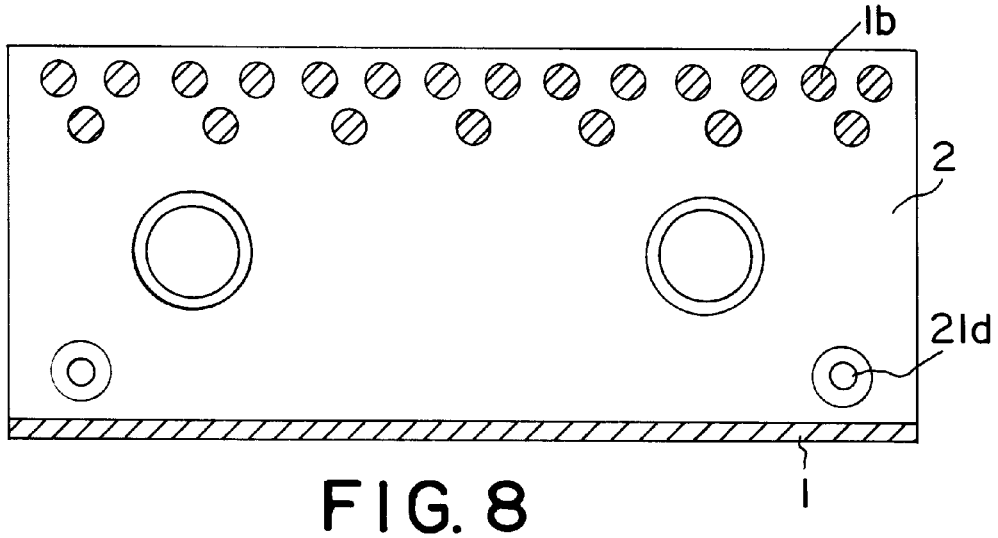
FIG. 8 is a detail view of still another embodiment showing a relationship between a catalyst body and a heat receiving fin shown in FIG. 1 in accordance with the present invention.

FIG. 8 shows another embodiment which can achieve the same effect as that of the embodiment shown in FIG. 7. The heat receiving fin 2 is formed with many small holes 1*b* at the upstream portion thereof. Other portions are the same as those in FIG. 7. The opposed area of the heat receiving fin 2 can be made smaller than the area of the catalyst body 1 in the upstream direction of the cooling path 3 as in the above embodiment.

Figure 9:
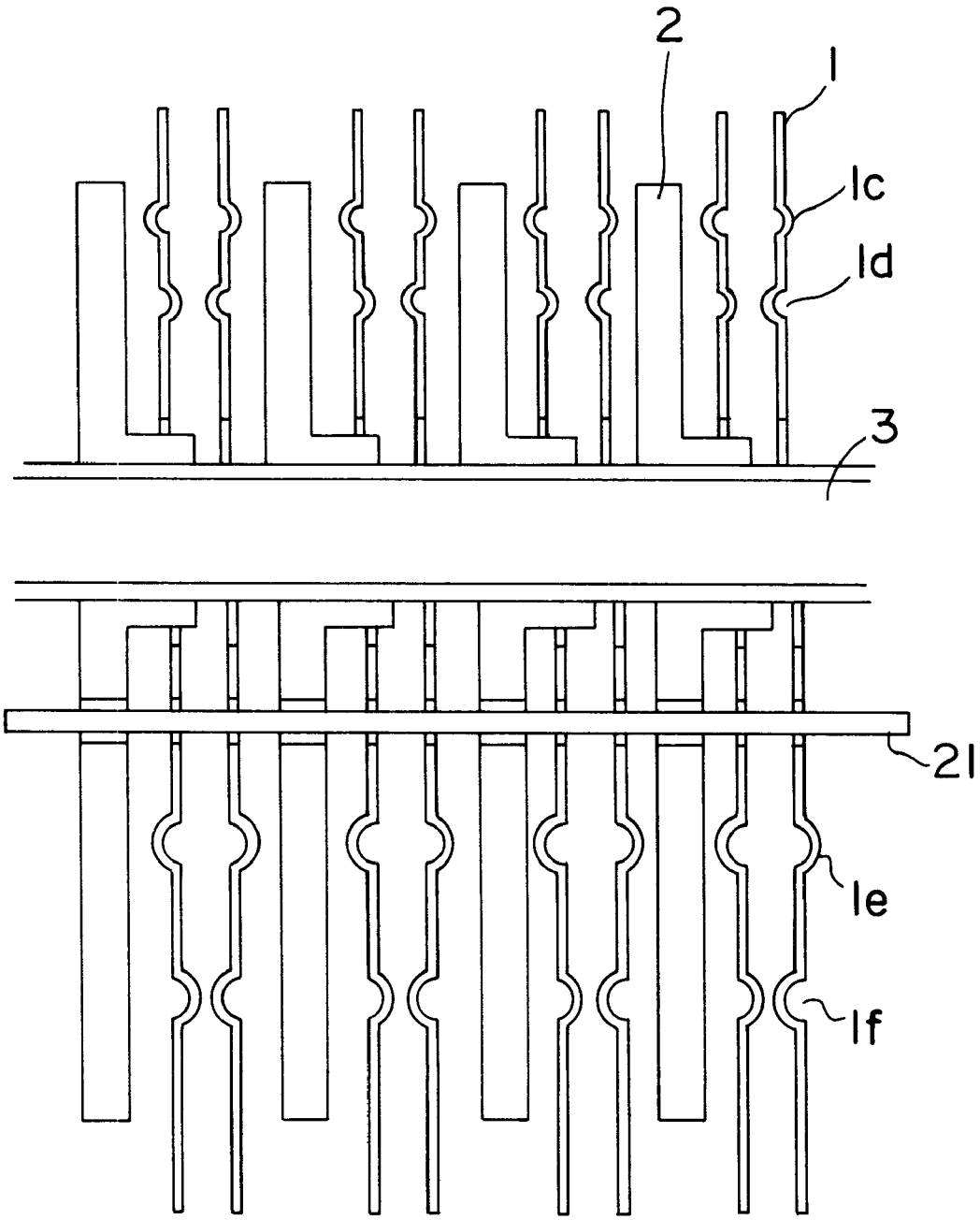
FIG. 9 is a detail view from another angle, showing a relationship between a catalyst body and a heat receiving fin shown in FIG. 1 in accordance with the present invention.

FIG. 9 is a detail view showing a relationship between the catalyst body 1, heat receiving fin 2, and the cooling path 3. The configuration is such that two plate-shaped catalyst bodies 1 are disposed between the heat receiving fins 2. The catalyst body 1 is provided with a plurality of protrusions 1*c*, 1*d*, 1*e* and 1*f*. The protrusions 1*d* and 1*f* are used to keep the distance between the two catalyst bodies 1 essentially constant, and the protrusions 1*c* and 1*e* are used to keep the distance between the catalyst body 1 and the heat receiving fin 2 essentially constant. Because of the construction in which the protrusions come into point contact with each other, not only the distance is kept constant, but also the heat is scarcely transferred. For example, if the catalyst body 1 and the heat receiving fin 2 are in face contact with each other, the heat receiving fin 2 is cooled heavily by the heat medium flowing in the cooling paths 3 and the temperature thereof is decreased. Therefore, the catalyst body 1 is cooled by the heat conduction from the catalyst body 1 to the heat receiving fin 2, and the temperature thereof is decreased, so that the catalytic combustion cannot be continued. In the case of point contact, heat transfer is effected mainly by radiation, so that the temperature of the catalyst body 1 is not decreased excessively. Also, if the catalyst bodies 1 are brought into contact with each other, the mixture cannot touch the contact surface, so that the catalytic combustion is not made at this portion. Therefore, partial temperature nonuniformity is formed in the catalyst body 1, and at the same time unburned gas leaks into the exhaust gas. Thereupon, the formation of protrusions is a very-effective means for making stable catalytic combustion. Although all the protrusions are formed on the catalyst body 1 in this embodiment, needless to say, the protrusions may be formed on the heat receiving fin 2 side to keep the distance between the catalyst body 1 and the heat receiving fin 2 constant. Reference numeral 21 denotes the penetrating member, which penetrates the catalyst bodies 1 and the heat receiving fins 2 to maintain the relative positional relationship between the two elements for a long period of time. Also, in this embodiment, the heat receiving fin 2 is made thicker than the catalyst body 1. The catalyst body 1 is configured thin so that the heat transfer quantity in the catalyst body itself is small, by which a high-temperature portion for stable combustion is formed on the upstream side. On the other side, the heat receiving fin 2 configured thick is effective in transferring heat effectively. If the temperature of the heat medium is approached by decreasing the heat gradient, the heat transfer quantity naturally increases. Thus, the two elements are required to have a different heat transfer performance, and the objective can be achieved by configuring the heat receiving fin 2 thicker than the catalyst body 1.

Figure 10:
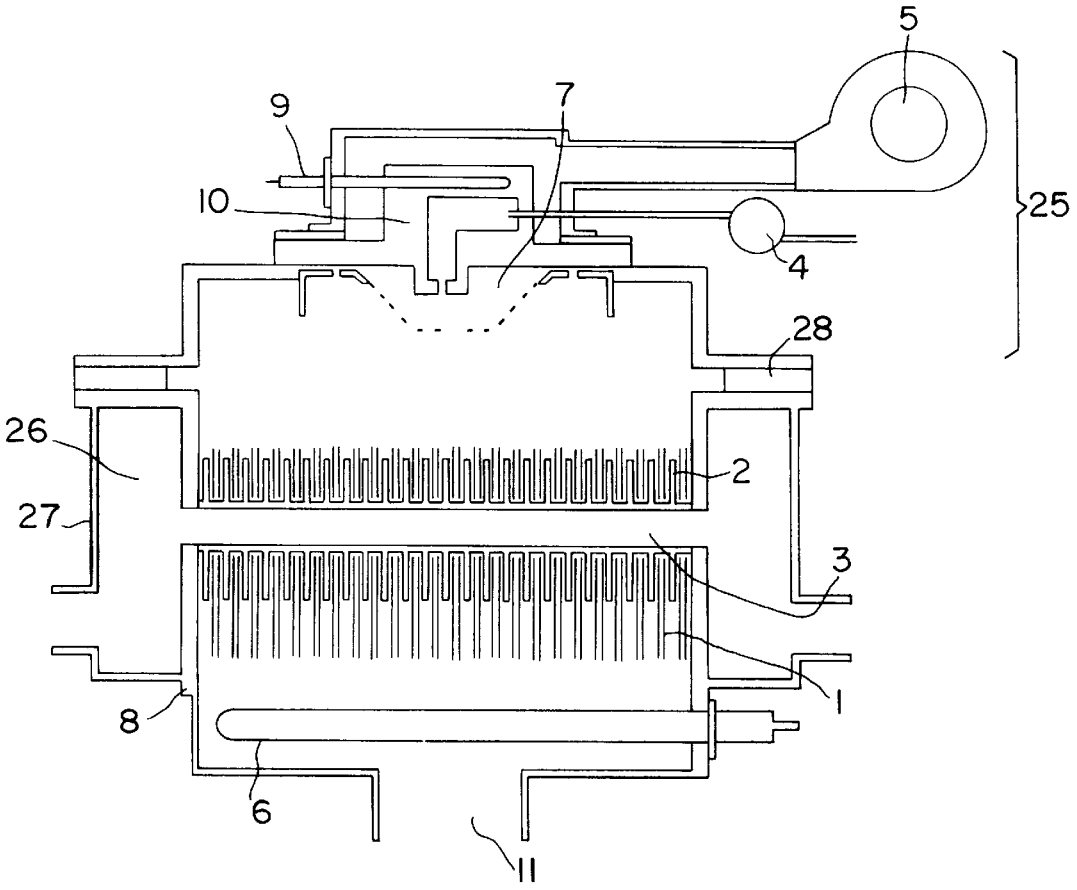
FIG. 10 is a sectional view showing a second embodiment of a combustion apparatus in accordance with the present invention.

FIG. 10 is a sectional view of a principal portion showing a second embodiment of a combustion apparatus in accordance with the present invention. The same elements as those shown in FIG. 1 are shown by the same reference numerals, and the explanation thereof is omitted. In this embodiment, a mixing unit 25 is formed by the fuel supply section 4, the air blowing section 5 for supplying combustion air, and the mixing section 7 for mixing fuel with air. Also, a heat receiving section consisting of the catalyst bodies 1 and the heat receiving fins 2 is provided in a housing 27 which consists of double walls and is formed with a heat medium passage 26 between the double walls, so that the cooling path 3 is made to communicate with the heat medium passage 26 of the housing 27. Reference numeral 28 denotes a sealing material for connecting the mixing unit 25 to the housing 27. The unitization provides easy assembly and maintenance. The use of a heat insulating material as the sealing material 28 prevents the movement of heat from the combustion section to the mixing unit 25 section, so that heat dissipation loss can be reduced. Also, by the configuration such that the housing in the heat receiving section consists of double walls and the heat medium is allowed to flow between the double walls, the heat dissipated from the housing surface can be recovered efficiently by the heat medium, so that the thermal efficiency as the equipment is improved. Also, in this embodiment, the electric heater 6 for preheating the catalyst bodies 1 is provided on the downstream side of the heat receiving section. In this case, the catalytic combustion starts from the downstream side of the catalyst bodies 1.

Figure 11:
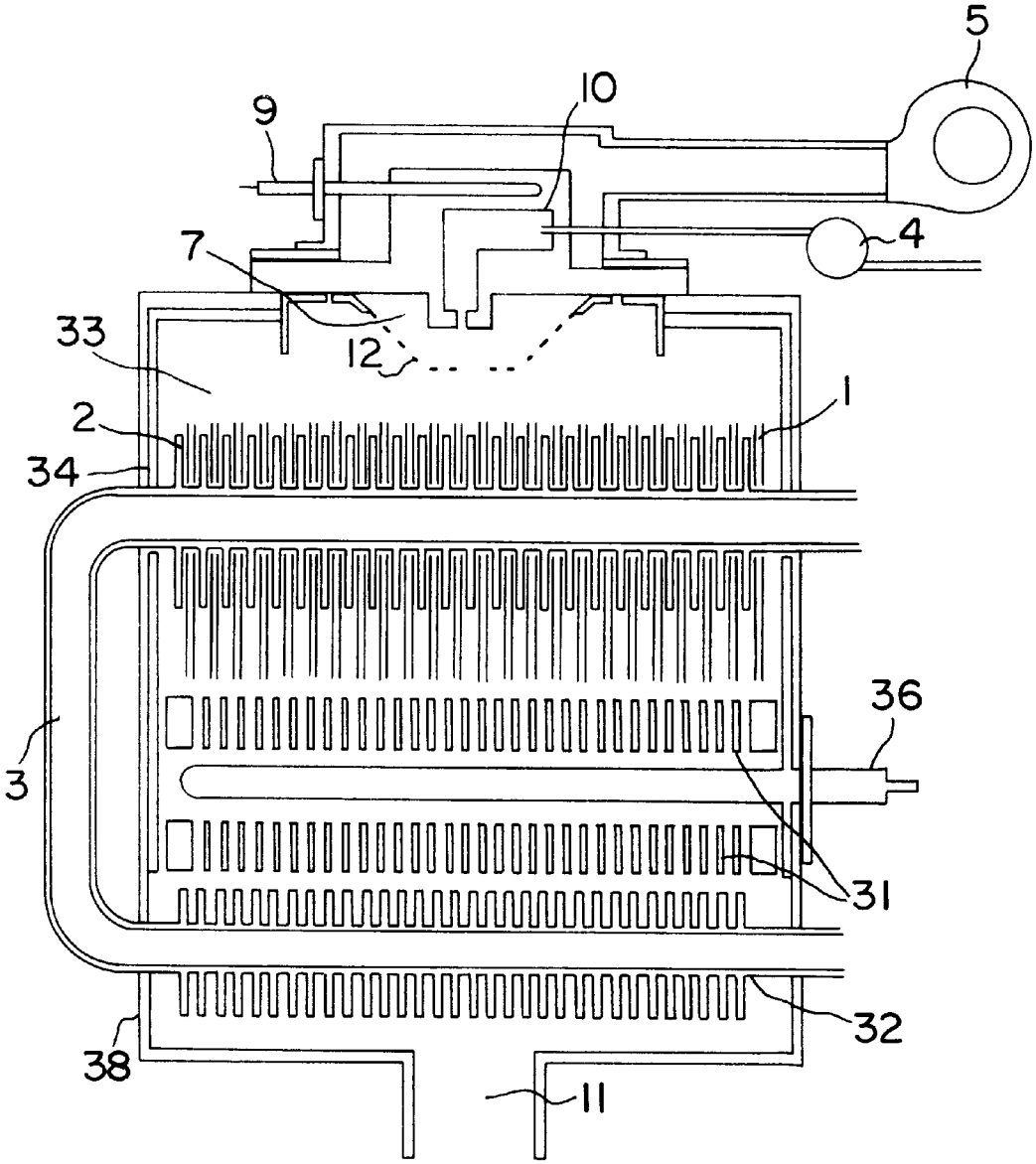
FIG. 11 is a sectional view showing a third embodiment of a combustion apparatus in accordance with the present invention.

FIG. 11 is a sectional view of a principal portion showing a third embodiment of a combustion apparatus in accordance with the present invention. This embodiment is so configured that second catalyst bodies are provided on the downstream side of the catalyst bodies 1 and a second heat receiving section is provided on the downstream side of the second catalyst bodies. The same elements as those shown in FIG. 1 are shown by the same reference numerals, and the explanation thereof is omitted. Reference numeral 31 denotes the second catalyst body configured by carrying a precious metal catalyst on a ceramic honeycomb carrier with high air permeability. Two sheets of second catalyst body are provided, and an electric heater 36 for preheating catalyst is provided therebetween. Reference numeral 33 denotes a combustion chamber, and 34 denotes a heat insulating material provided inside the housing 38. The cooling path 3 penetrates both of the heat receiving section consisting of the catalyst bodies 1 and the like and the second heat receiving section 32 having many fins to recover heat.

In this embodiment, the combustion starts in the second catalyst bodies 31. After the catalytic combustion is started in the second catalyst bodies 31 which are heated to a sufficient activation temperature by the electric heater 36 for preheating, the combustion starts to spread gradually to the upstream direction of the second catalyst bodies 31, and further spreads to the downstream ends of the catalyst bodies 1 from the upstream surface of the second catalyst body 31. The catalytic combustion of the catalyst bodies 1 spreads gradually from the downstream side to the upstream side, and finally reaches the most upstream ends of the catalyst bodies 1. At this time, a substantially steady-state combustion state as the combustor is established. The heat medium in the cooling path 3 can be circulated by using a pump or the like at the time suitable in relation to the heat use side, for example, simultaneously with the combustion start or when a usable temperature is reached. At this time, if a temperature detector is provided on the outlet side of the cooling path, that time can be determined easily. The recovered heat is supplied to the use side (not shown) such as a heating apparatus via the heat medium in the cooling path. Most of the combustion heat generated on the surface of the catalyst body 1 is transferred from the heat receiving fin to the heat medium. The combustion heat generated on the surface of the second catalyst body 31 and the remaining heat which is not transferred by the heat receiving section of the first catalyst body 1 are transferred effectively to the heat medium in the second heat receiving section 32, and supplied to the use side. In the process from the ignition in the second catalyst body 32 to the steady-state combustion, the temperature of the second catalyst body 31 is liable to excessively rise because the temperature of the first catalyst body 1 is not sufficiently high and the heat transfer quantity to the upstream heat receiving section in which the catalyst bodies 1 are provided is small. Therefore, the proper method is to make catalytic combustion at a relatively small combustion quantity at the time when the combustion of the catalyst bodies 1 rises and subsequently to transfer the combustion quantity to the rated value. The catalyst temperature during the steady-state combustion is kept in the range of about 350 to 900° C., and flameless combustion, which does not form flame, continues on the catalyst surface. The catalytic combustion has high reactivity even at low temperatures, and has a lower temperature than the flame combustion. Therefore, clean combustion, in which the exhaust gas contains a very small amount of harmful substances such as nitrogen oxides and carbon monoxide, is continued. By providing the catalytic combustion section and the heat receiving section in a double manner, clean exhaust gas and further improved thermal efficiency can be achieved. Further, in this configuration, a second catalyst unit is configured by the second catalyst bodies 31 and the electric heater 36, which is provided adjacent to (here, between) the second catalyst bodies 31, for heating the second catalyst bodies 31, and further the second heat receiving section 32 provided on the downstream side of the second catalyst bodies 31 is provided in a housing similar to that shown in the embodiment in FIG. 10, which consists of double walls and formed with a heat medium passage between the double walls, and the cooling path of the second heat receiving section 32 is made communicate with the heat medium passage. Thereby, the maintenance and assembly properties are improved, the heat dissipation loss is reduced, and the practicality is improved as compared with the second embodiment.

Figure 12:
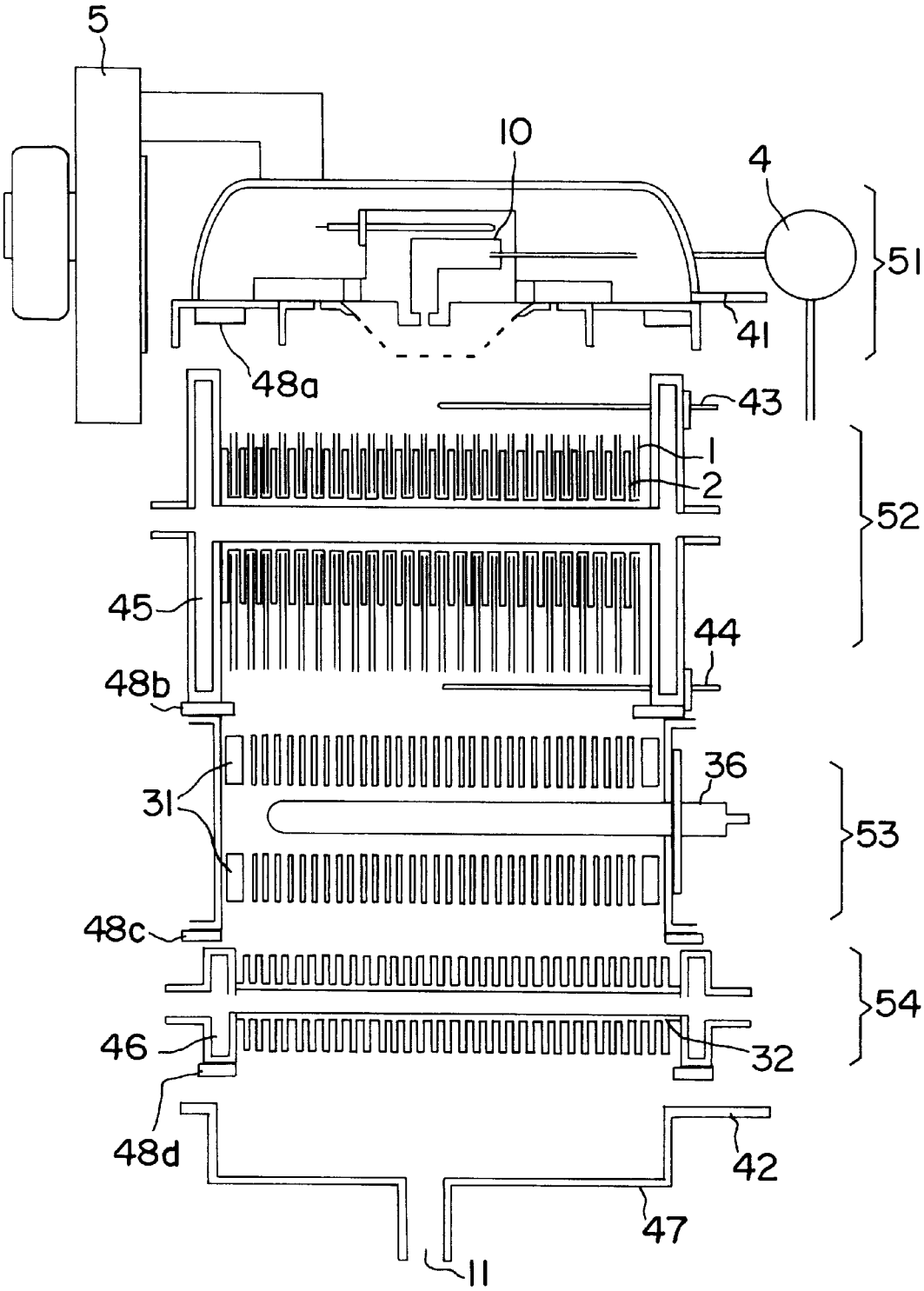
FIG. 12 is a sectional view showing a fourth embodiment of a combustion apparatus in accordance with the present invention.

FIG. 12 is a sectional view of a principal portion showing a fourth embodiment of a combustion apparatus in accordance with the present invention. In this embodiment, the whole equipment is unitized. The principal portion is configured by four units; a mixing unit 51 for mixing fuel with combustion air, a first catalyst unit 52 formed by a heat receiving section consisting of the catalyst bodies 1 and the heat receiving fins 2 and a first housing 45 which consists of double walls and is formed with a heat medium passage between the double walls, a second catalyst unit 53 configured by the second catalyst bodies 31 and the electric heater 36 for heating, and a heat recovery unit 54 formed by the second heat receiving section 32 and a second housing 46 which consists of double walls and is formed with a heat medium passage between the double walls. To join the four units in the order of the mixing unit 51, the first catalyst unit 52, the second catalyst unit 53, and the heat recovery unit 54, sealing materials 48*a*, 48*b* and 48*c* are used at the respective joint portions, and a sealing material 48*d* is provided at the connecting portion with an exhaust gas hood 47. Reference numerals 43 and 44 denote temperature detectors for monitoring combustion. Reference numeral 41 denotes an upper fitting provided in the mixing unit 51, and 42 denotes a lower fitting provided in the exhaust gas hood 47.

Figure 13:
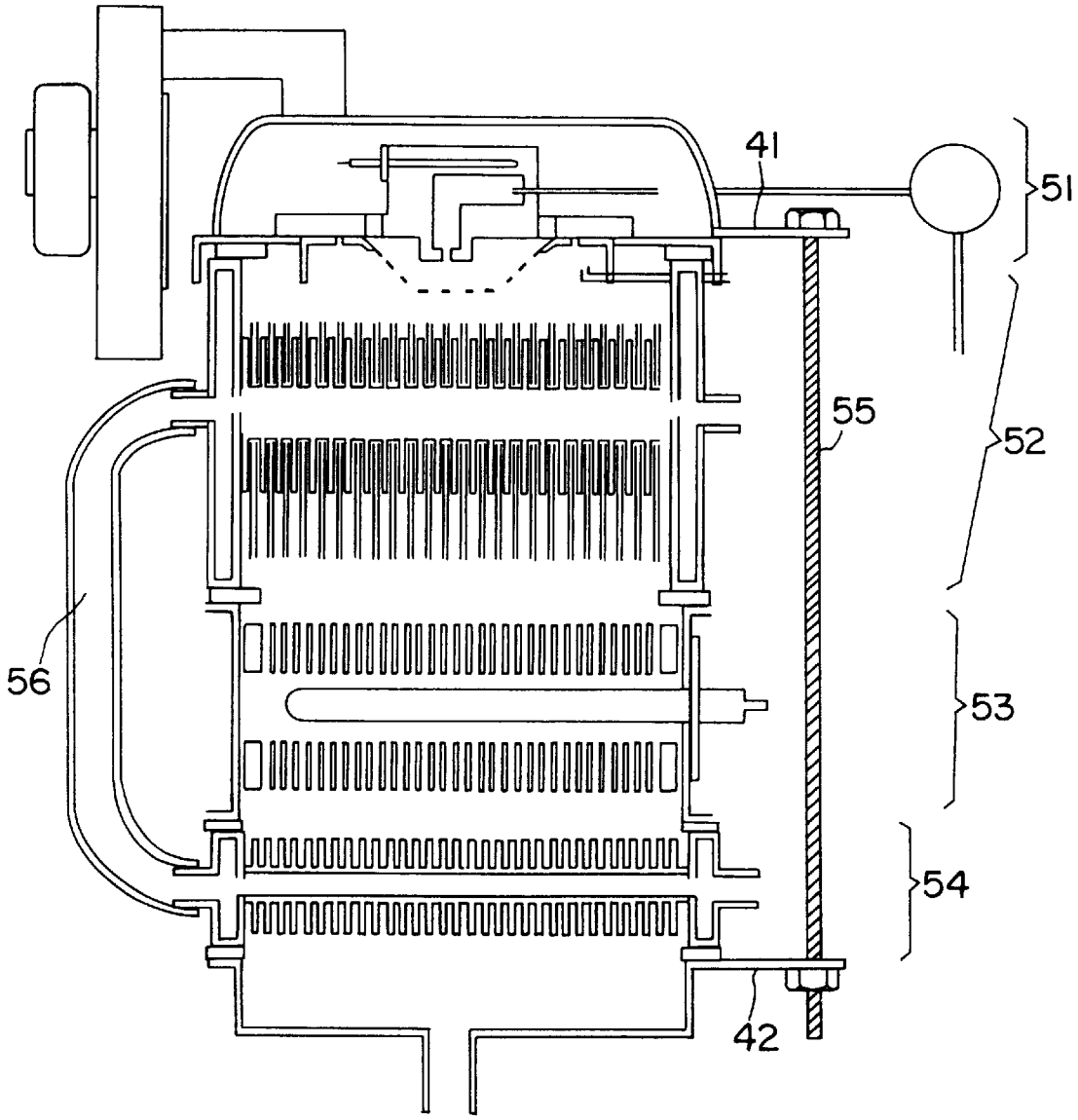
FIG. 13 is an assembly sectional view of the combustion apparatus shown in FIG. 12 in accordance with the present invention.

FIG. 13 shows a state in which both of the fittings are connected by a fastener 55 to assemble all the units. Reference numeral 56 denotes a communication path for providing communication between the heat medium passage formed in the first housing 45 of the first catalyst unit 52 and the heat medium passage formed in the second housing 46 of the heat recovery unit 54.

By dividing the principal portion into units and configuring the whole in the manner as described above, a heat medium passage can be formed easily on the surface of equipment, so that the heat dissipation loss from the apparatus surface can be minimized.

Figure 14:
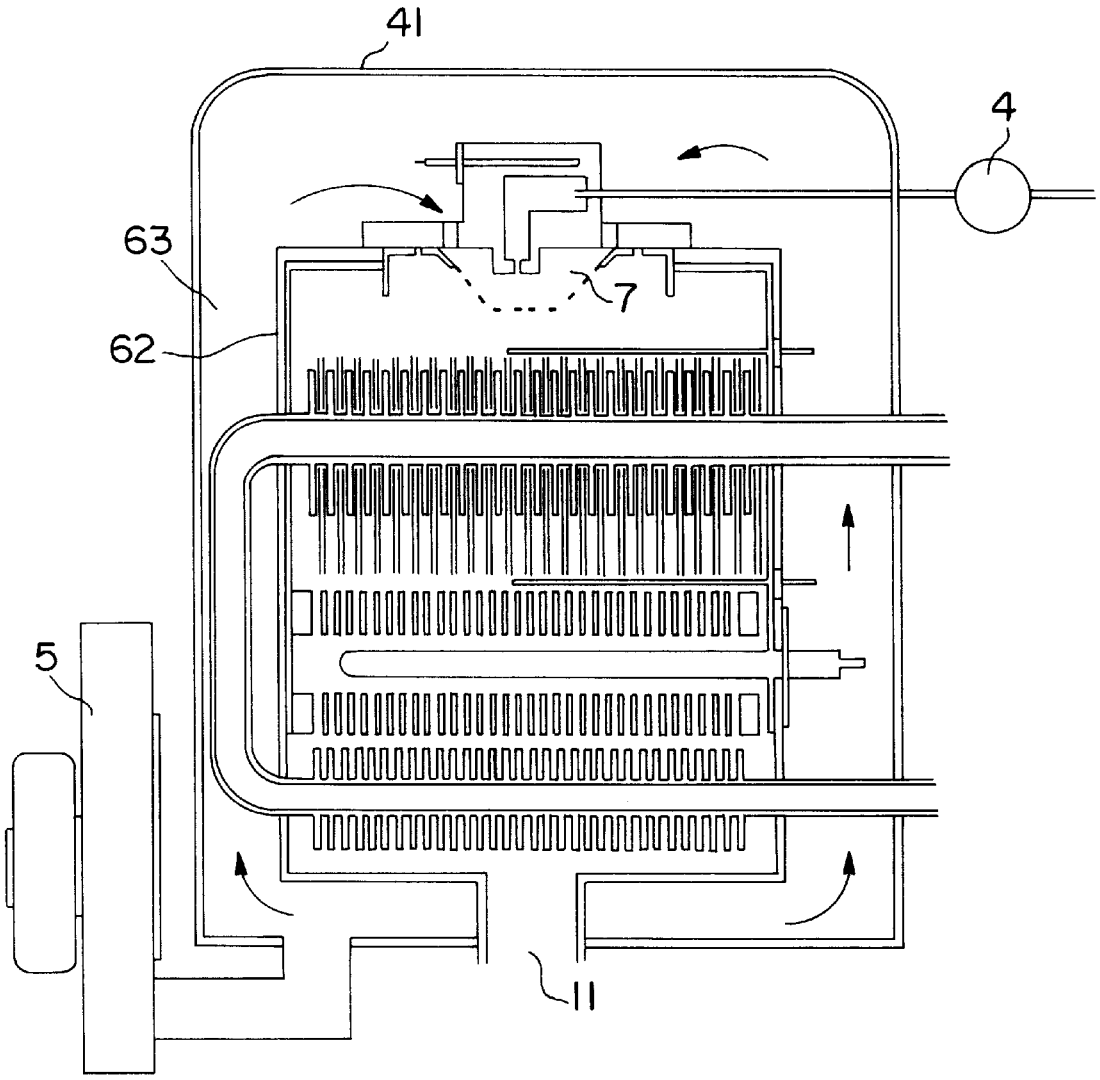
FIG. 14 is a sectional view showing a fifth embodiment of a combustion apparatus in accordance with the present invention.

FIG. 14 is a sectional view of a principal portion showing a fifth embodiment of a combustion apparatus in accordance with the present invention. In this embodiment, the combustion apparatus in accordance with the embodiment shown in FIG. 11 is further covered with an external housing 61, by which an external air passage 63 is formed between an internal housing 62 and the external housing 61. The combustion air which has passed through the external air passage 63 between the housings formed by double walls is supplied to the mixing section. Although the air blowing section 5 is provided at the lower side part of the equipment in this embodiment, it may be provided near the upper part. The air sent from the air blowing section 5 is mixed with the fuel sent from the fuel supply section 4 in the mixing section 7 to form a mixture, which is sent into the combustion chamber. During combustion, the surface temperature of the internal housing 62 increases, but the dissipated heat is transferred efficiently to the air passing through the external air passage 63 and utilized to preheat the combustion air, so that heat dissipation loss from the whole equipment can be decreased significantly. Further, even if unburned gas leaks from the internal housing 62, it is recovered by the combustion air and sent to the combustion chamber again, so that it is not dissipated to the outside of the equipment. Also, since the temperature of the external housing 61 is kept at a low temperature by the air flow in the external air passage 63, the safety of equipment is enhanced.

Figure 15:
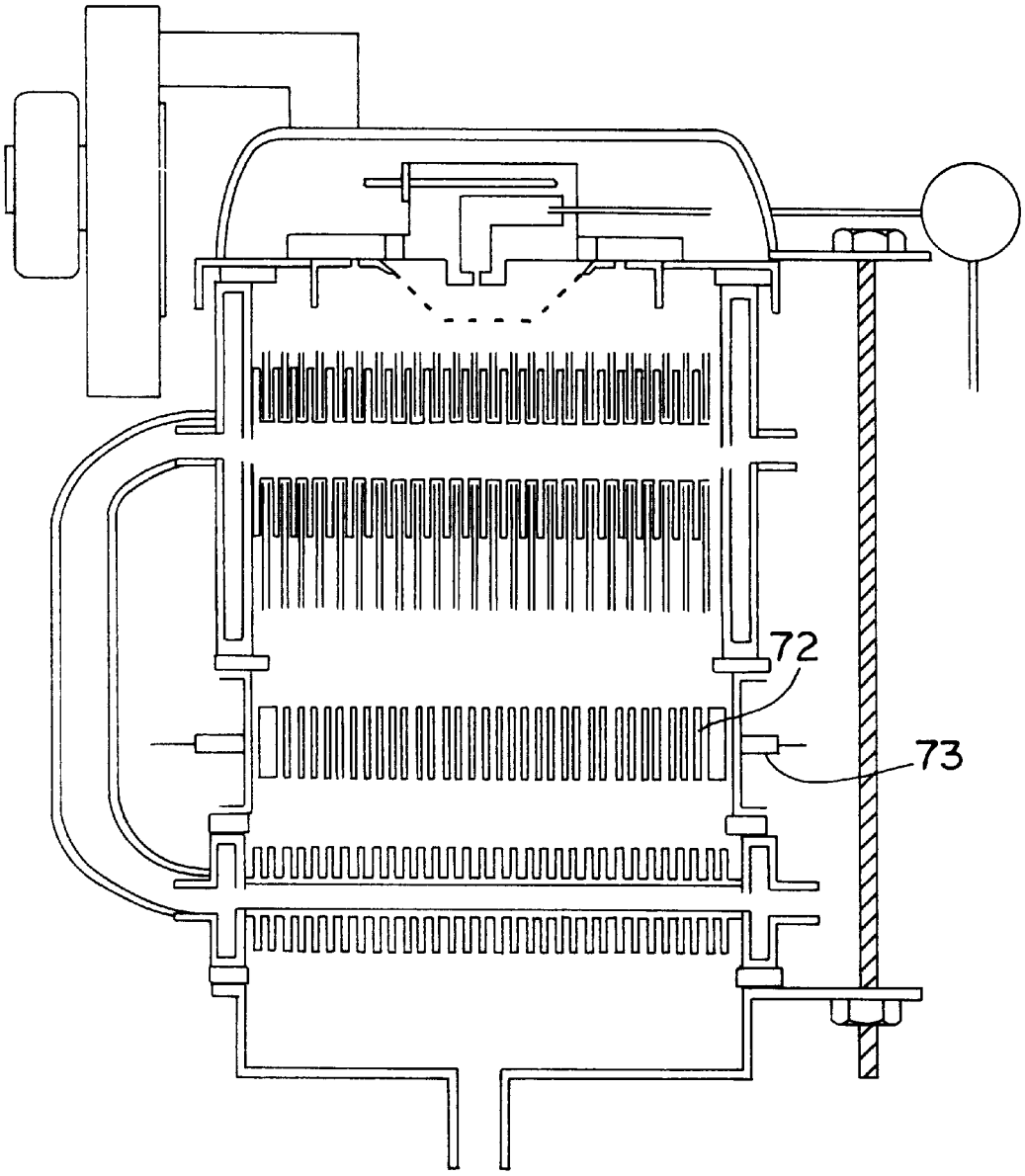
FIG. 15 is a sectional view showing a sixth embodiment of a combustion apparatus in accordance with the present invention.
Figure 16:
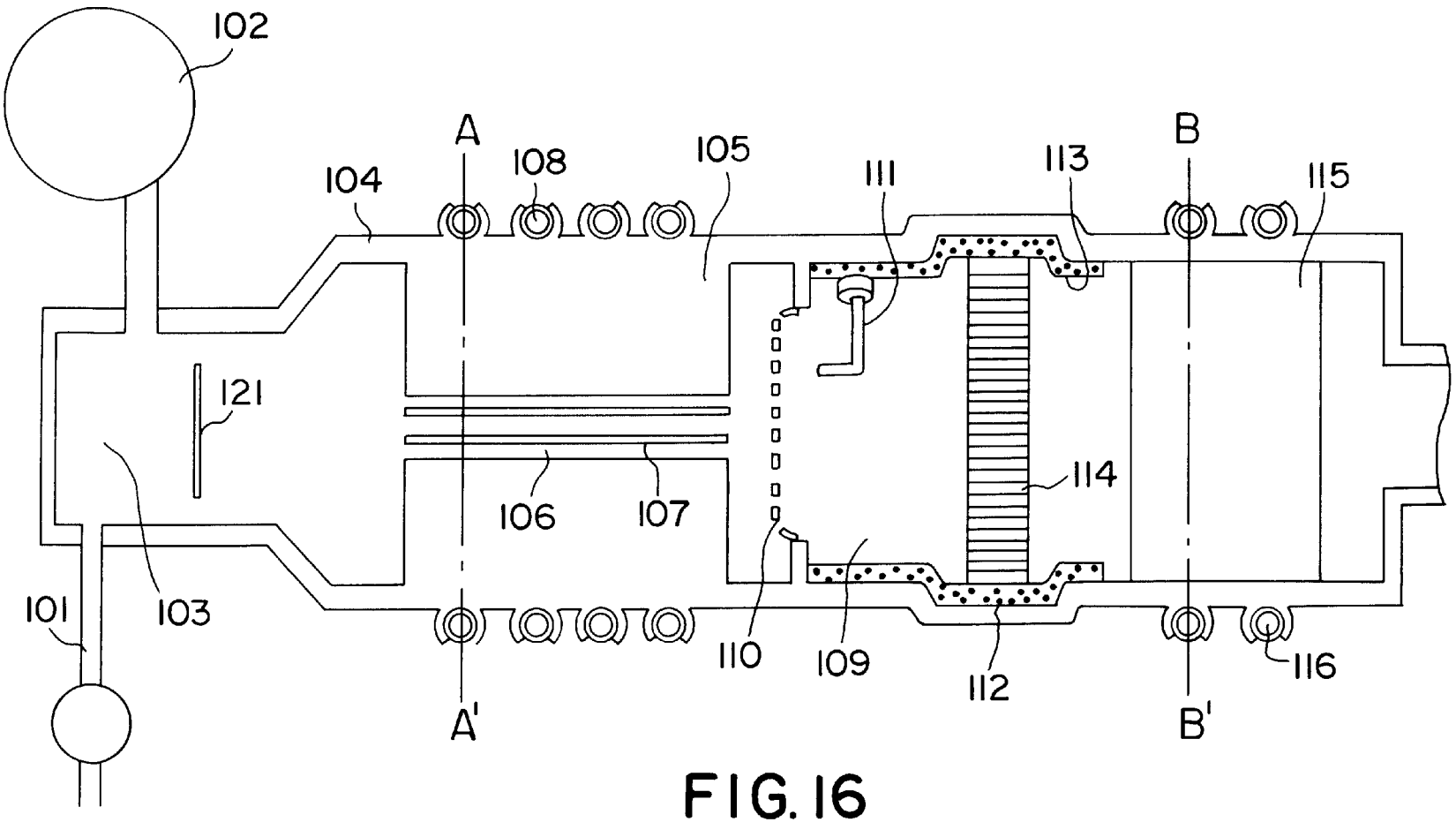
FIG. 16 PRIOR ART
FIG. 16 is a sectional view of a conventional combustion apparatus related to the present invention.

FIG. 15 is a sectional view of a principal portion showing a sixth embodiment of a combustion apparatus in accordance with the present invention. This embodiment is mainly based on the embodiment shown in FIG. 13, and characterized in that the second catalyst body 72 is configured by an air-permeable carrier and a catalyst layer provided on the surface of the carrier, and the carrier is mainly formed of a conductive heat-generating material. The carrier is suitably formed of a material mainly containing silicon carbide, and carries a catalyst such as precious metal on the surface thereof to form a second catalyst body 72. At this time, since the carrier has a suitable conductivity, the carrier itself can serve as a resistance heating element. Reference numeral 73 denotes an electrode. By the current flow from the electrode 73, the second catalyst body 72 itself generates heat, so that the activation state can be established. That is, the heat capacity of the substance to be heated becomes lower than the method in which an electric heater or the like is used to preheat the catalyst body, and accordingly sudden rising of combustion can be performed. Thereby, not only the power consumption during preheating can be reduced, but also the waiting time before the combustion start is shortened so that the convenience as the equipment is improved. Although the carrier is formed mainly of a silicon carbide material in this embodiment, the carrier material is not limited to this. The carrier may be configured so that a certain kind of heat-resistant metal is formed into a honeycomb shape or the like having high air permeability, and a catalyst is carried on the surface thereof. The conductivity of material is often proportional to the thermal conductivity. In this case as well, since the catalyst carrier has higher thermal conductivity than a ceramic material, the temperature uniformity of the second catalyst body 72 increases, so that the exhaust gas can further be made clean.

In the present invention, the heat receiving fin and the catalyst body, which are opposed at least on the upstream side of the cooling path, may be configured so that the upstream end of the heat receiving fin is located on the inside of the upstream end of the catalyst body. Also, on the downstream side, the opposed heat receiving fin and catalyst body may be configured so that the downstream end of the heat receiving fin is located on the inside (upstream side) of the downstream end of the catalyst body.

Thus, the present invention achieves the following effects.

1. Since a stable high-temperature portion of catalyst can be formed in a proper temperature range lower than the heat resistance temperature of catalyst, the temperature change of the catalyst body is small under various conditions, so that the stabilization of catalytic combustion can be achieved.

2. Since the temperature distribution of catalyst body can be set properly under various conditions, the above state can be maintained for a long period of service time, so that the deterioration in catalyst can be inhibited. Therefore, a combustion apparatus having high practicality can be provided.

3. The surface temperature of the equipment itself is decreased, and thereby the heat dissipation loss is reduced, so that the efficiency of heat utilization can further be increased.

4. Since the rise time is shortened, the electric power for preheating the catalyst can be saved, so that energy saving can be achieved.

5. A wide variety of fuels ranging from gas fuels to liquid fuels can be used, and a combustion apparatus having high operability can be provided.

What is claimed is:

1. A combustion apparatus comprising:

a fuel supply section;

an air blowing section for supplying combustion air;

a mixing section for mixing said fuel with said combustion air to obtain an air/fuel mixture;

a plurality of first catalyst bodies which are arranged substantially in parallel with each other to divide the downstream location in the flow direction of said mixture into a plurality of flow paths; and a first heat receiving section configured by a plurality of heat receiving fins arranged in flow paths divided by said first catalyst bodies and a cooling path penetrating said heat receiving fins, wherein an area of one of said heat receiving fins on the upstream side of said cooling path is smaller than a further area of one of said first catalyst bodies on the upstream side of said cooling path which opposes said one of said heat receiving fins.

2. A combustion apparatus according to claim 1, wherein the upstream end of said heat receiving fin located on the upstream side of said cooling path is substantially at an equal distance from said cooling path.

3. A combustion apparatus according to claim 1, wherein the upstream end of said heat receiving fin is of a wave form, or the upstream end of said heat receiving fin has many small holes.

4. A combustion apparatus according to claim 1, wherein the upstream end of said first catalyst body protrudes from the upstream end of said heat receiving fin toward the upstream side in the flow direction of said mixture.

5. A combustion apparatus according to claim 1, wherein on the upstream side of said cooling path, the area of said heat receiving fin increases gradually from the upstream side to the downstream side.

6. A combustion apparatus according to claim 1, wherein said heat receiving fin is thicker than said first catalyst body.

7. A combustion apparatus according to claim 1, wherein at least one surface of opposed surfaces of said first catalyst body or said heat receiving fin is formed with plurality of protrusions.

8. A combustion apparatus according to claim 1, wherein at least one penetrating member is provided to penetrate both of said first catalyst bodies and said heat receiving fins.

9. A combustion apparatus according to claim 1, wherein a mixing unit is formed by said fuel supply section, said air blowing section, and said mixing section.

10. A combustion apparatus according to claim 1, wherein said first catalyst bodies and said first heat receiving section are arranged in a housing configured by double walls having a heat medium passage therebetween, and said cooling path and said heat medium passage in the housing communicate with each other.

11. A combustion apparatus according to claim 1, wherein said combustion apparatus further comprises a second catalyst body provided on the downstream side of said first catalyst body and a second heat receiving section provided on the downstream side of said second catalyst body.

12. A combustion apparatus according to claim 11, wherein a second catalyst unit is configured by said second catalyst body and an electric heater, which is provided adjacent to said second catalyst body, for heating said second catalyst body.

13. A combustion apparatus according to claim 11, wherein said second heat receiving section is arranged in a housing configured by double walls having a heat medium passage therebetween, and a cooling path of said second heat receiving section and said heat medium passage communicate with each other.

14. A combustion apparatus comprising:

a mixing unit configured by fuel and combustion air;

a first catalyst unit configured by catalyst bodies, heat receiving fins, and a first housing formed by double walls having a heat medium passage therebetween;

a second catalyst unit configured by a second catalyst body and an electric heater for heating; and a heat recovery unit configured by a second heat receiving section and a second housing formed by double walls having a heat medium passage therebetween, characterized in that said mixing unit, said first catalyst unit, said second catalyst unit, and said heat recovery unit are joined in the named order, and the heat medium passage formed in the first housing of said first catalyst unit and the heat medium passage formed in the second housing of said heat recovery unit communicate with each other.

15. A combustion apparatus comprising:

a fuel supply section;

an air blowing section for supplying combustion air;

a mixing section for mixing said fuel with said combustion air to obtain an air/fuel mixture;

a plurality of first catalyst bodies which are arranged substantially in parallel with each other to divide the downstream location in the flow direction of said mixture into a plurality of flow paths; and a first heat receiving section configured by a plurality of heat receiving fins arranged in flow paths divided by said first catalyst bodies and a cooling path penetrating said heat receiving fins, wherein an upstream end of one of said heat receiving fins is located on the inside of a further upstream end of one of said first catalyst bodies at least on an upstream side of said cooling path which opposes said one of said heat receiving fins.

16. A combustion apparatus according to claim 15, wherein the upstream end of said heat receiving fin located on the upstream side of said cooling path is substantially at an equal distance from said cooling path.

17. A combustion apparatus according to claim 15, wherein the upstream end of said heat receiving fin is of a wave form, or the upstream end of said heat receiving fin has many small holes.

18. A combustion apparatus according to claim 15, wherein the upstream end of said first catalyst body protrudes from the upstream end of said heat receiving fin toward the upstream side in the flow direction of said mixture.

19. A combustion apparatus according to claim 15, wherein on the upstream side of said cooling path, the area of said heat receiving fin increases gradually from the upstream side to the downstream side.

20. A combustion apparatus according to claim 15, wherein said heat receiving fin is thicker than said first catalyst body.

21. A combustion apparatus according to claim 15, wherein at least one surface of opposed surfaces of said first catalyst body or said heat receiving fin is formed with a plurality of protrusions.

22. A combustion apparatus according to claim 15, at least one penetrating member is provided to penetrate both of said first catalyst bodies and said heat receiving fins.

23. A combustion apparatus according to claim 15, wherein a mixing unit is formed by said fuel supply section, said air blowing section, and said mixing section.

24. A combustion apparatus according to claim 15, wherein said first catalyst bodies and said first heat receiving section are arranged in a housing configured by double walls having a heat medium passage therebetween, and said cooling path and said heat medium passage in the housing communicate with each other.

25. A combustion apparatus according to claim 15, wherein said combustion apparatus further comprises a second catalyst body provided on the downstream side of said first catalyst body and a second heat receiving section provided on the downstream side of said second catalyst body.

26. A combustion apparatus according to claim 25, wherein a second catalyst unit is configured by said second catalyst body and an electric heater, which is provided adjacent to said second catalyst body, for heating said second catalyst body.

27. A combustion apparatus according to claim 25, wherein said second heat receiving section is arranged in a housing configured by double walls having a heat medium passage therebetween, and a cooling path of said second heat receiving section and said heat medium passage communicate with each other.

* * * * *